United States Patent [19]

King

[11] 4,387,787

[45] Jun. 14, 1983

[54] LOUDSPEAKER HAVING ACOUSTIC IMPEDANCE FRONTAL LOADING ELEMENT

[75] Inventor: John A. King, Martinsville, Ind.

[73] Assignee: Harman International Industries, Northridge, Calif.

[21] Appl. No.: 255,401

[22] Filed: Apr. 20, 1981

[51] Int. Cl.[3] ..... H04R 1/28

[52] U.S. Cl. ..... 181/155; 181/166

[58] Field of Search ..... 181/146, 148, 151, 155, 181/166, 175, 199; 179/180, 1 E, 184

[56] References Cited

U.S. PATENT DOCUMENTS 2,400,281 5/1946 Anderson ..... 181/166 X 4,058,688 11/1977 Nishimura et al. ..... 179/180 X

*Primary Examiner*—L. T. Hix

*Assistant Examiner*—Thomas H. Tarcza

*Attorney, Agent, or Firm*—Barnes & Thornburg

[57] ABSTRACT

An improved acoustic impedance for a direct radiating dynamic loudspeaker having a natural Q greater than about 1.2, is substantially planar and is positioned in front of and covers the projected frontal radiation area of the diaphragm or cone of the loudspeaker. The acoustic impedance element is supported about its periphery and comprises a fibrous felt material having an air flow resistance in the range of about 50–100 cu. ft. per min. at 0.5 p.s.i. pressure drop, a density in the range of about 6–12 oz. per sq. yd. and a thickness in the range of 0.03–0.09 in. The acoustic impedance element is an air permeable continuous sheet and is comprised substantially entirely of fibers of synthetic materials, such as, for example, polyester, which are relatively impervious to moisture. The Q of the speaker including the damping element is in the range of about 0.75–1.0.

11 Claims, 3 Drawing Figures

FIG. 1
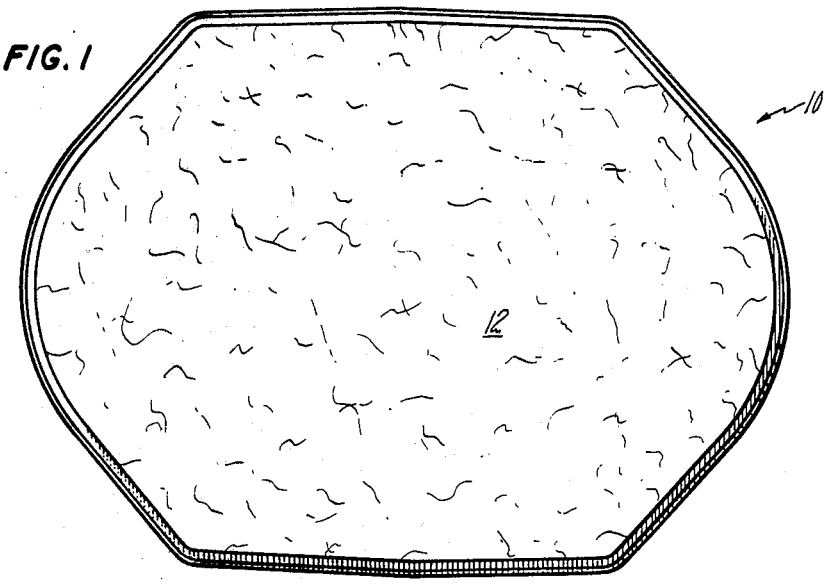
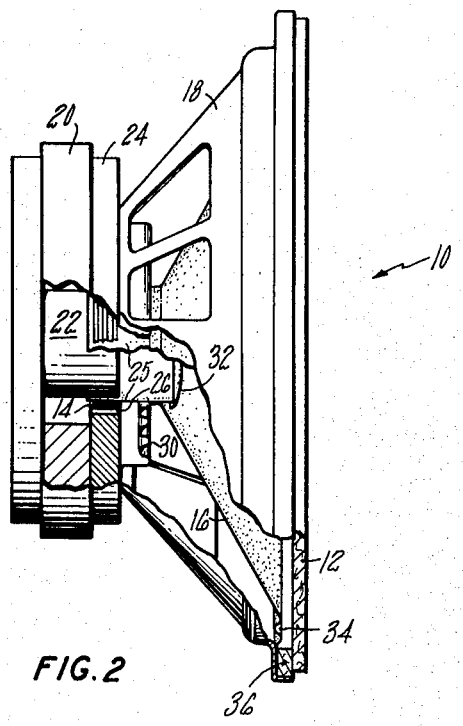
FIG. 2

LOUDSPEAKER HAVING ACOUSTIC IMPEDANCE FRONTAL LOADING ELEMENT

DESCRIPTION

TECHNICAL FIELD

This invention relates to loudspeakers and more particularly to improved loudspeakers having acoustic impedance frontal loading elements.

BACKGROUND ART

Electrodynamic loudspeakers, especially those intended to be of low cost as for utilization in automobiles and the like, typically use small volume or low weight magnets for the diaphragm motor, resulting in a low damping factor on the moving system, quantitatively defined by "Q", resulting in a "Q" in excess of approximately 1.2. This low damping factor has a deleterious effect on the acoustical performance in the vicinity of the principal (lowest) resonant frequency of the moving system characterized by a peak in the steady state acoustical output with a concomitant increase in harmonic and intermodulation distortion and impaired transient performance resulting in "ringing" of the system. The same low cost speakers with small magnets also typically utilize sound radiating diaphragms commonly called cones, having a low mass characterized by a weight to radiating area ratio typically in the 0.04–0.15 gm/in.$^2$ range, in order to maximize the sensitivity. The low mass cone also tends to increase the amplitude of distributed mode resonances in the cone, which results in an increased sound output in the upper frequency range, i.e. above about 2,000 Hz, and which may not be desirable. A further performance problem in low cost, small size, low cone-mass loudspeakers is that the principal resonant frequency, $f_0$, which establishes the low frequency limit of performance in many applications, cannot be made as low as desired due to cone manufacturing limitations involved in felting the outer cone suspension areas sufficiently thin. The principal resonant frequency for a given mass cone is a function of the cone's suspension compliance which in turn is a function of the thickness of the suspension area of the cone.

The increased levels of sound output in the vicinity of the principal resonance frequency and in the upper frequency range of the loudspeaker are not always desirable performance attributes. A uniform or "flat" amplitude vs. frequency characteristic is often desired but difficult to achieve.

One technique for reducing the amplitude of the peak in the sound output in the vicinity of the principal resonant frequency is the use of an acoustic resistance covering the openings in the frame of the loudspeaker on the rear side of the cone, as discussed in an article entitled "Acoustic Resistance Damping for Loudspeakers" by John L. Grauer in AUDIO, Vol. 49, No. 3, p. 22, March 1965. The increased damping is accomplished by the increased resistance encountered by the volume flow of air set in motion by the cone as it passes through the acoustical resistance material. This approach is generally effective in attenuating the resonant peak in the response, however, it does not offer a means for reducing the level of the upper frequency response or for beneficially lowering the principal resonant frequency. The Grauer article considers the possibility of applying resistive damping in front of the cone to filter acoustically the highest frequencies, where that is desirable, however, no discussion of the geometry and characteristics of that latter type of damping nor of a means for concomitantly lowering the principal resonant frequency of the loudspeaker is included.

In U.S. Pat. No. 2,840,178 entitled "Device for the Reproduction of Sound", the provision of an acoustical impedance for loudspeakers positioned in front of the loudspeaker cone is discussed. The acoustic impedance consists of an acoustic resistance and an acoustic mass. The resistance preferably "consists of a rigid or reinforced disc of wire-net, or a perforated metal sheet on which there is cemented a material acting as acoustic resistance". An opening in the center of the disc acts as acoustic mass. In an alternative embodiment, the acoustic mass is constituted by an auxiliary diaphragm or cone disposed in front of the low frequency diaphragm of the loudspeaker. That auxiliary diaphragm may either be provided with openings which are filled or covered with a material acting as acoustic resistance, or it may be made entirely of an air permeable material which acts as an acoustic resistance, but in either instance appears to take the form of a conical diaphragm. No further details are provided concerning the characteristics of the material.

A further patent, U.S. Pat. No. 4,012,605 entitled "Input/Output Transducer with Damping Arrangement", provides a grill in front of a speaker/microphone cone, and some of the interstices within the grill contain segments of a damping material. Although the damping material is said to improve the frequency response, that improvement would appear to be limited to use in the microphone mode, inasmuch as the speaker response curve 26 of FIG. 7 continues to show a relatively significant peak.

It is a principal object of the present invention to provide an improved loudspeaker utilizing a supplemental damping impedance comprised of acoustic resistance and an integral acoustic mass element operative on the frontal radiation of a loudspeaker. Included within this object is the provision of acoustic impedance especially suited for use with loudspeakers in automotive applications requiring relative immunity to moisture. Also included within this object is the provision of such acoustic impedance with a low cost speaker normally having a Q greater than about 1.2.

In accordance with the invention, there is provided in a direct radiator dynamic loudspeaker having a natural Q greater than about 1.2 an improved acoustic impedance. The acoustic impedance element is substantially planar and is positioned in front of and covers the projected frontal radiation area of the diaphragm or cone. The acoustic impedance element is supported only about its periphery and comprises a fibrous felt material having an airflow resistance in the range of about 50–100 cu. ft. per min. at 0.5 psi pressure drop, a density in the range of about 6–12 oz. per sq. yard and a thickness in the range of 0.03–0.09 in. The acoustic impedance element is in an air permeable continuous sheet and is comprised substantially entirely of fibers of synthetic materials, as for instance polyester, which are relatively impervious to moisture. The Q of the speaker including such damping element is less than about 1.2, being about 0.75–1.0.

BRIEF DESCRIPTION OF THE DRAWINGS

FIG. 1 is a front elevational view of a loudspeaker including the acoustic impedance of the invention;

FIG. 2 is a side elevational view, partly in section, of the loudspeaker of FIG. 1.

BEST MODE FOR CARRYING OUT THE INVENTION

Figure 3:
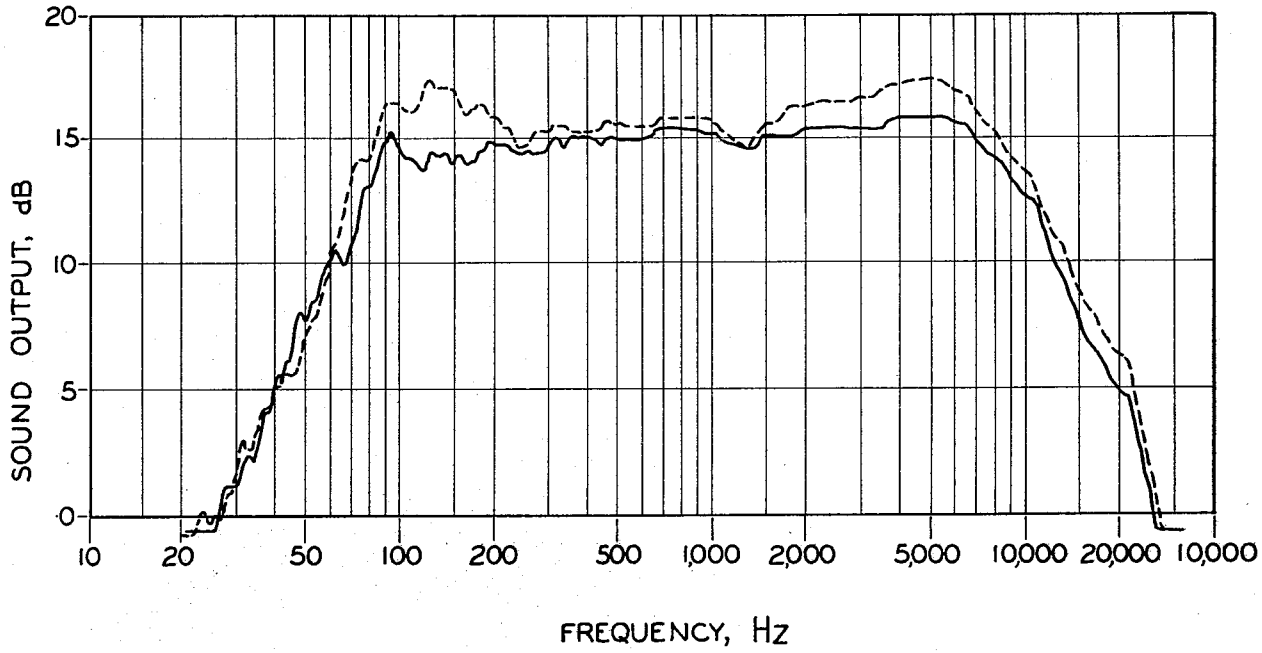
FIG. 3 is a graph illustrating the acoustic output vs. frequency response characteristics of loudspeakers with and without acoustical impedance respectively.

Referring to FIGS. 1 and 2, there is illustrated a loudspeaker 10 which includes the improved acoustic impedance element 12 of the invention. The loudspeaker 10 is of the direct radiator type and includes a moving voice coil 14 and a diaphragm in the form of cone 16. A frame or basket 18, generally of metal, serves as the principal structural member of the loudspeaker. The motor for the cone 16 is formed by annular magnet 20 disposed about center pole 22 and rearwardly of front pole 24. The voice coil 14 concentrically encircles center pole 22 and is mounted on a cylindrical form 25 in annular air gap 26 between the annular front pole 24 and the center pole 22. The cone 16 is affixed at its apex end to the moving coil form 25 for axial displacement in response to the interaction of the variable electrical current through the coil 14 with the field of magnet 20. A voice coil centering suspension element 30, commonly called a spider, is secured both to the front pole 24 and to the coil form 25 for positioning and facilitating operation of the voice coil and the cone. A dust cap 32 covers the coil form 25. The base of cone 16 is suitably suspended from the annular rim of basket 18 by an annular compliant suspension 34 which may be unitary with the cone or separate therefrom.

The damping element 12 of the invention is secured to the front surface of the annular rim of basket 18 through an intermediate gasket or pad ring 36. Pad ring 36 may be made of hot melt type material and is adhered to both the basket 18 and the impedance element 12 in a manner described in U.S. Pat. No. 4,191,865, also by the inventor of the present application.

The impedance element 12 is a continuous sheet of air-permeable fibrous felt material which covers the frontal projected area of the cone 16. Impedance element 12 is supported only at its peripheral region by the pad ring 36 such that it is effectively planar and is spaced from the surface of cone 16 sufficiently to avoid contact therewith during operation. Although the fibrous felt material of impedance element 12 might be of cotton, wool or some similar natural material, it is particularly desirable that the fibers be of a synthetic material which is relatively hydrophobic and remains relatively impervious to and unaffected by water, water vapor and other liquids which may readily find their way on to its surface when the speaker 10 is mounted in or to a horizontal surface, such as the instrument panel of an automobile. Polyesters and similar synthetics are particularly suited for this application. Additionally, although the impedance element 12 should be air permeable, the density of its fibers should be sufficient to prevent solid particulates of all but the smallest sizes from passing through the damper and interfering with the operation of the cone 16.

Specifically, the impedance element 12 of the preferred embodiment is a polyester felt having an airflow resistance of about 50–100 cu. ft. per min. with a pressure drop of about 0.5 psi and a density in the range of about 6–12 oz. per sq. yard in a nominal thickness in the range of 0.03–0.09 in. An acoustic impedance having these properties functions effectively to not only increase the damping in the vicinity of the principal resonant frequency but to also significantly reduce the amplitude of the acoustic response above 2,000 Hz without significantly diminishing the range of the upper frequency response. Also, this acoustic impedance significantly lowers the principal resonant frequency and both the harmonic and the intermodulation distortion in the sound output. The effect of lowering the principal resonance frequency results from sympathetic motion of the felt damping element 12, supported only at its periphery, in this low frequency range which effectively increases the mass of the moving system. The use of thinner, denser materials with about the same flow resistance results in excessive stiffness and causes spurious noise due to insufficient internal damping of the material. The reduction in distortion accompanying a decrease in the principal resonant frequency was generally unexpected inasmuch as typically an increase in distortion occurs with the decrease in the resonant frequency.

Referring to FIG. 3, the amplitude vs. frequency response of a conventional 5″×7″ speaker without the acoustic impedance element 12 is depicted by the dotted line 40. Similarly, the acoustic output vs. frequency response of an identical 5″×7″ speaker 10 including the acoustic impedance element 12 described is depicted by the solid line 50. The frequency response 40 of a conventional speaker is seen to have a significant peak in the region of 90–200 Hz which is in the vicinity of the principal resonant frequency, $f_0$, and has a Q of about 1.7, the Q value being a measure of the degree of response peaking at resonance. That response curve 40 also exhibits a broad peak in the upper frequency range above 2,000 Hz. The principal resonant frequency, $f_0$, for that speaker is seen to be about 100 Hz. Although not depicted in FIG. 3, tests on that conventional speaker revealed the total harmonic distortion to be about 29% and the total intermodulation distortion to be about 18%.

The solid line trace 50 of FIG. 3 is representative of the acoustic output vs. frequency response of the same 5″×7″ speaker, but with the impedance element 12 of the invention added thereto. The felt has an airflow resistance of about 100 cu. ft. per min. and a density of about 12 oz. per sq. yard. It can be seen in response curve 50 that the peaks in the response both in the vicinity of resonance and above 2,000 Hz have been significantly diminished. The Q is now about 0.8–0.85. The principal resonant frequency, $f_0$, is lowered to about 84 Hz from about 100 Hz, a decrease of about 16%. Moreover, the total harmonic distortion for speaker 10 with impedance element 12 has been reduced from 29% to 10%, a decrease of 65%, and the intermodulation distortion has been reduced from 18% to 13%, a decrease of 27%.

By using a felt impedance element 12 having a density of about 8 oz. per sq. yard and an airflow resistance of about 50 cu. ft. per min., the Q becomes about 0.9–0.95 and the response is somewhat improved in the 7–10 kHz range, although the acoustic output may be excessive in the 3–4 kHz range. The general advantages of the invention, however, continue to apply.

Thus it will be seen that the effect of adding the described impedance element 12 to the speaker 10 in the manner hereinbefore described is a significant improvement in the measurable performance of the speaker. The peaks otherwise occurring at either end of the response curve have now been relatively flattened and the principal resonant frequency, $f_0$, has been lowered to extend the overall response range. Moreover, the use of a synthetic fiber felt, such as polyester felt, having the aforedescribed characteristics results in a relatively low cost dynamic loudspeaker which is particularly suitable for utilization in environments, such as the instrument panel of an automobile, which may be subject to high moisture and/or high dust and dirt levels.

Although this invention has been shown and described with respect to detailed embodiments thereof, it will be understood by those skilled in the art that various changes in form and detail thereof may be made without departing from the spirit and scope of the claimed invention.

I claim:

1. A direct radiating dynamic loudspeaker of the type having low mass diaphragm and magnet means, the improvement comprising:

a substantially planar acoustic impedance means positioned in front of and covering the projected frontal area of the diaphragm;

said acoustic impedance means being nonrigid and being supported only at the periphery thereof; and said acoustic impedance means composed of fibrous material having an airflow resistance providing a Q less than about 1.2.

2. For a direct radiating dynamic loudspeaker of the type having an unimproved Q greater than about 1.2, the improvement comprising:

a substantially planar nonrigid acoustic impedance means positioned in front of and covering the projected frontal area of said loudspeaker;

said acoustic impedance means being supported only at the peripheral region thereof; and said acoustic impedance means composed of fibrous material having an airflow resistance providing an improved Q less than about 1.2.

3. A direct radiating dynamic loudspeaker of the type including low mass diaphragm and magnet means, the improvement comprising:

means for reducing the principal resonant frequency, said means comprising:

nonrigid acoustic impedance means positioned in front of and covering the projected frontal area of the loudspeaker, said impedance means being unsupported except about its periphery.

4. A direct radiating dynamic loudspeaker of the type including low mass diaphragm and magnet means, the improvement comprising:

acoustic impedance means operative to lower the principal resonant frequency and to modify response characteristics in the upper frequency range, said acoustic impedance means positioned in front of and covering the projected frontal area of the loudspeaker, said impedance means being a nonrigid fibrous material supported only about its periphery.

5. The loudspeaker of claim 1 wherein said acoustic impedance means material is an air-permeable continuous sheet.

6. The loudspeaker of claim 1 wherein said fibrous material is felt comprised substantially entirely of synthetic fibers.

7. The loudspeaker of claim 2 wherein said fibrous material is felt comprised substantially entirely of synthetic fibers.

8. The loudspeaker of claim 6 wherein said synthetic fibers are polyester.

9. The loudspeaker of claim 1 wherein the Q is in the range of about 0.75–1.0 with the inclusion of said acoustic impedance means.

10. The loudspeaker of claim 6 wherein said density of said fibrous felt material is at least about 8 oz. per square yard.

11. The loudspeaker of claim 8 wherein said density of said fibrous felt material is at least about 8 oz. per square yard.

* * * * *